US006934984B2

(12) United States Patent
Marsden et al.

(10) Patent No.: US 6,934,984 B2
(45) Date of Patent: Aug. 30, 2005

(54) BED RAIL WITH CLAMPING FORCE INDICATOR

(75) Inventors: Andrew W. Marsden, Hingham, MA (US); Kurt Nygren, Harvard, MA (US)

(73) Assignee: Cosco Management, Inc., Wilmington, DE (US)

( * ) Notice: Subject to any disclaimer, the term of this patent is extended or adjusted under 35 U.S.C. 154(b) by 59 days.

(21) Appl. No.: 10/734,392

(22) Filed: Dec. 12, 2003

(65) Prior Publication Data

US 2004/0123387 A1 Jul. 1, 2004

Related U.S. Application Data

(60) Provisional application No. 60/433,113, filed on Dec. 13, 2002.

(51) Int. Cl.[7] ..... A47C 21/08
(52) U.S. Cl. ..... 5/426; 5/425; 5/430
(58) Field of Search ..... 5/425–430; 340/686.1

(56) References Cited

U.S. PATENT DOCUMENTS

| | | | | | |
|---|---|---|---|---|---|
| 2,071,155 | A | * | 2/1937 | Alexander | 5/658 |
| 3,419,922 | A | | 1/1969 | Malherbe | |
| 3,932,903 | A | | 1/1976 | Adams et al. | |
| 4,186,456 | A | | 2/1980 | Huempfner | |
| 4,612,679 | A | | 9/1986 | Mitchell | |
| 4,641,385 | A | | 2/1987 | Peters et al. | |
| 4,747,171 | A | | 5/1988 | Einsele et al. | |
| 5,038,430 | A | | 8/1991 | Bly | |
| 5,394,580 | A | | 3/1995 | Foster et al. | |
| 5,519,905 | A | | 5/1996 | Bernstein et al. | |
| 5,522,100 | A | | 6/1996 | Schilling et al. | |
| 5,577,277 | A | | 11/1996 | Sundberg et al. | |
| 5,781,945 | A | * | 7/1998 | Scherer et al. | 5/426 |
| 5,784,732 | A | | 7/1998 | Vail | |
| 6,021,533 | A | * | 2/2000 | Ellis et al. | 5/600 |
| 6,446,283 | B1 | | 9/2002 | Heimbrock et al. | |
| 2003/0024047 | A1 | | 2/2003 | Wu | |

* cited by examiner

*Primary Examiner*—Alexander Grosz
(74) *Attorney, Agent, or Firm*—Barnes & Thornburg LLP

(57) ABSTRACT

A bed rail is disclosed for use with a mattress. The bed rail is configured to be clamped to the mattress with a clamping force. A clamping force indicator is used to provide information about the clamping force.

28 Claims, 9 Drawing Sheets

BED RAIL WITH CLAMPING FORCE INDICATOR

This application claims priority under 35 U.S.C. § 119(e) to U.S. Provisional Application No. 60/433,113, filed Dec. 13, 2002, which is hereby incorporated by reference herein.

CROSS-REFERENCE

Cross-reference is made to co-pending U.S. patent application Ser. No. 10/735,356 entitled "Bed Rail"and U.S. patent application Ser. No. 10/734,346 entitled "Bed Rail With Fold Controller", each of which is assigned to the same assignee, each of which is assigned to the same assignee as the present application, is filed concurrently herewith, and is hereby incorporated by reference herein.

BACKGROUND

The present disclosure relates to bed rails. Bed rails are used with beds to help retain individuals in bed.

SUMMARY

According to the present disclosure, a bed rail comprises a mattress clamping device and a clamping force indicator. The mattress clamping device is adapted to clamp a mattress with a clamping force to mount the bed rail alongside the mattress. The clamping force indicator is configured to indicate whether the clamping force complies with predetermined clamping force criteria.

The mattress clamping device includes a side rail and a clamp. The clamp includes a fixed jaw and a movable jaw. The fixed jaw is adapted to be positioned under the mattress in a fixed position. The movable jaw is configured to be moved toward the fixed jaw and to act through the clamping force indicator to move the side rail toward the mattress to clamp the mattress between the side rail and the fixed jaw with the clamping force to mount the side rail alongside the mattress. The movable jaw is configured to be moved away from the mattress to unclamp the mattress.

During clamping of the mattress, the movable jaw moves relative to the side rail due to continued movement of the movable jaw toward the fixed jaw and engagement between the side rail and the mattress. The clamping force indicator includes a spring to resist such movement of the movable jaw relative to the side rail. Such resistance promotes display of a clamped signal in a window formed in the movable jaw when the clamping force complies with the predetermined clamping force criteria. It also promotes display of an unclamped signal in the window when the clamping force does not comply with the predetermined clamping force criteria.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figures 1, 2:
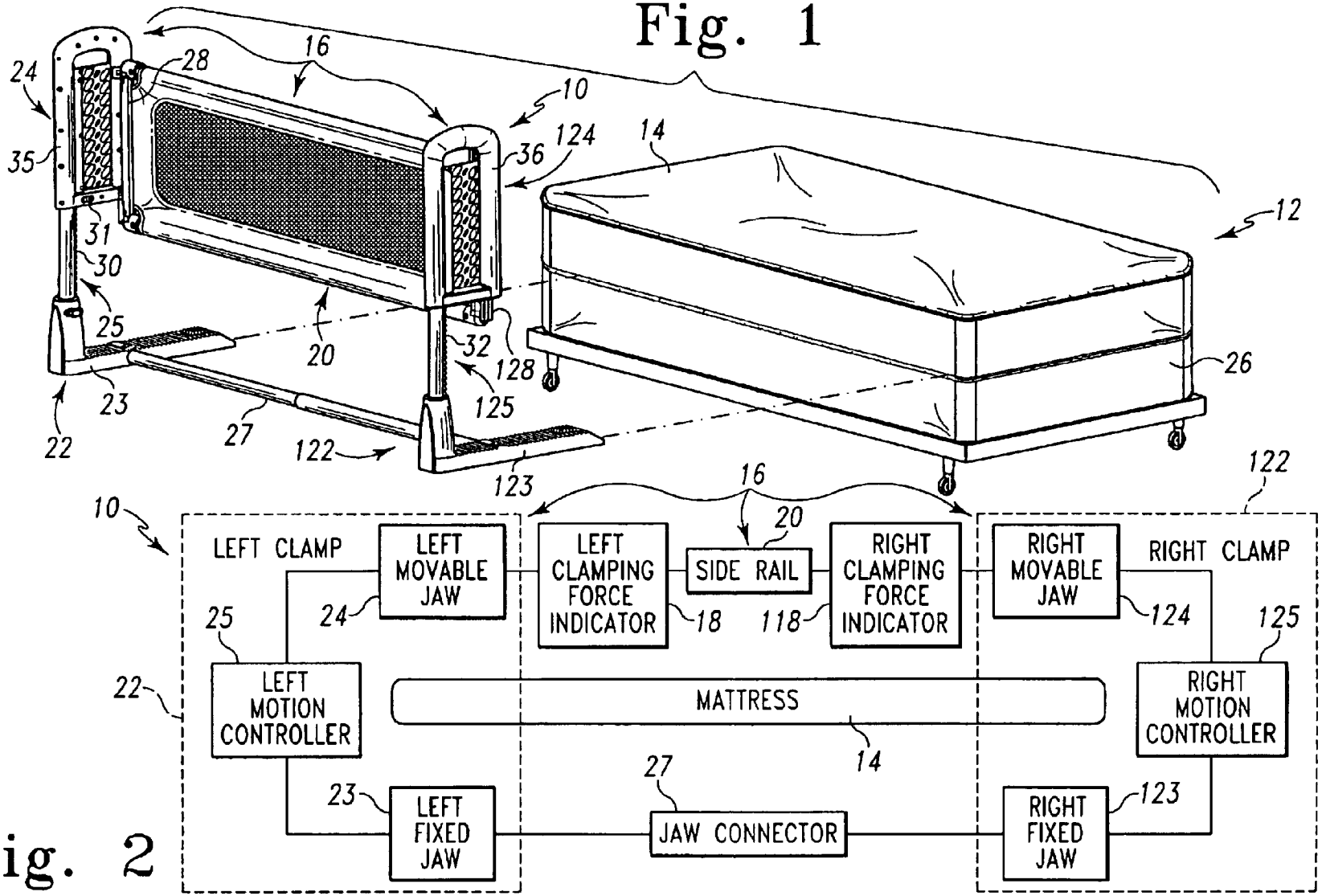
FIG. 1 is a perspective view showing a bed and a bed rail including a side rail extending between left and right clamps configured to cooperate with the side rail to clamp a mattress of the bed to position the side rail alongside the mattress.
FIG. 2 is a diagrammatic view showing components of the bed rail including the side rail, the left and right clamps, a left clamping force indicator configured to indicate whether a left clamping force applied to the mattress by the side rail and the left clamp complies with predetermined clamping force criteria, and a right clamping force indicator configured to indicate whether a right clamping force applied to the mattress by the side rail and the right clamp complies with the predetermined clamping force criteria.

A bed rail 10 is configured to be mounted to a bed 12, as suggested, for example, in FIG. 1. When so mounted, bed rail 10 is used to inhibit unintended movement of a person (not shown) out of bed 12. When bed rail 10 is no longer needed, it may be removed from bed.

Bed rail 10 is configured to clamp a mattress 14 included in bed 12 to mount bed rail 10 to bed 12. Bed rail 10 includes a mattress clamping device 16 that is shown, for example, in FIG. 1 and is used to clamp mattress 14 with a clamping force to mount bed rail 10 alongside mattress 14. A clamping force indicator included in bed rail 10 is configured to provide information about the clamping force. In the illustrated embodiment, bed rail 10 includes two clamping force indicators 18, 118 which are shown diagrammatically, for example, in FIG. 2. Each indicator 18, 118 is configured to indicate whether a clamping force applied to mattress 14 complies with predetermined clamping force criteria.

Mattress clamping device 16 includes a side rail 20, a left clamp 22, and a right clamp 122, as shown, for example, in FIGS. 1 and 2. Each clamp 22, 122 is configured to cooperate with side rail 20 to clamp mattress 14 with a clamping force to mount side rail 20 alongside mattress 14. Left clamp 22 cooperates with side rail 20 to clamp mattress 14 with a left clamping force and right clamp 122 cooperates with side rail 20 to clamp mattress 14 with a right clamping force. Left clamping force indicator 18 is used to indicate whether the left clamping force complies with the predetermined clamping force criteria. Right clamping force indicator 118 is used to indicate whether the right clamping force complies with the predetermined clamping force criteria.

Left clamp 22 includes a left fixed jaw 23, a left movable jaw 24, and a left motion controller 25 and right clamp 122 includes a right fixed jaw 123, a right movable jaw 124, and a right motion controller 125, as shown diagrammatically, for example, in FIG. 2. Fixed jaws 23, 123 are configured to be positioned under mattress 14 in a fixed position between mattress 14 and an underlying box spring unit 26. A jaw connector 27 is coupled to left and right fixed jaws 23, 123.

Movable jaws 24, 124 are configured to move relative to fixed jaws and to act through indicators 18, 118 to move side rail 20 relative to mattress 14 to clamp and unclamp mattress 14, as suggested, for example, in FIGS. 5, 6, 10, 11, 13, and 14. Left movable jaw 24 is configured to move toward left fixed jaw 23 to move a left end portion 28 of side rail 20 toward mattress 14 to clamp mattress 14 with the left clamping force between left end portion 28 and left fixed jaw 23 upon application of an elevation adjustment force 30 to left movable jaw 24. Left movable jaw 24 is configured to move away from left fixed jaw 23 to move left end portion 28 away from mattress 14 to unclamp mattress 14. Right movable jaw 124 is configured to move toward right fixed jaw 123 to move a right end portion 128 of side rail 20 toward mattress 14 to clamp mattress 14 with the right clamping force between right end portion 128 and right fixed jaw 123 upon application of elevation adjustment force 30 to right movable jaw 124. Right movable jaw 124 is configured to move away from right fixed jaw 123 to move right end portion 128 away from mattress 14 to unclamp mattress 14.

Figure 10:
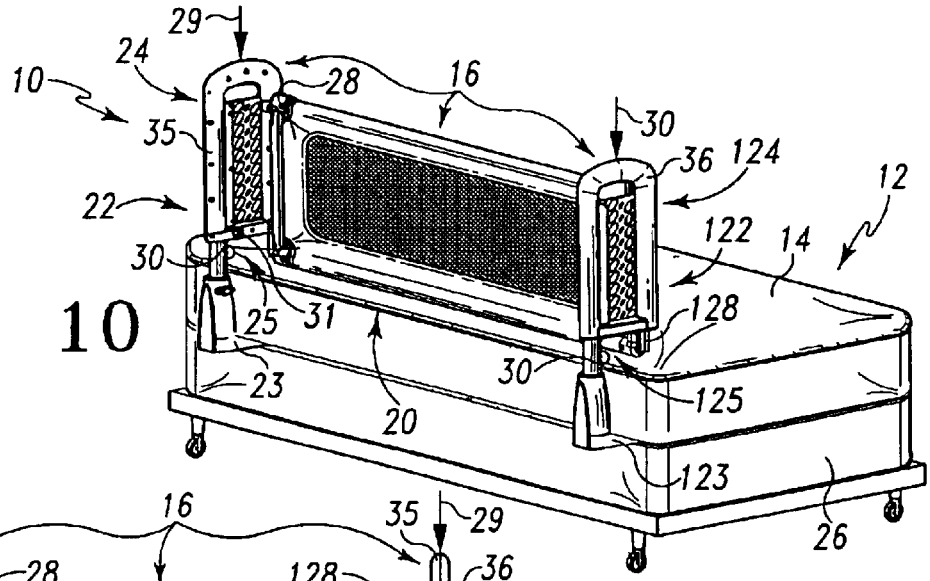
FIG. 10 is a perspective view showing movement of the left and right movable jaws toward left and right fixed jaws of the left and right clamps to move the side rail toward the mattress to cause initial engagement between the side rail and the mattress.
Figure 11:
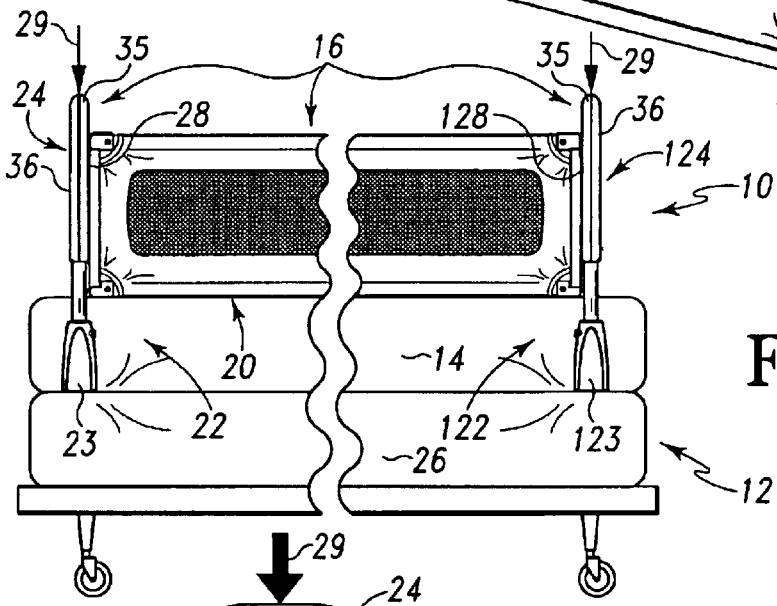
FIG. 11 is a rear elevation view of the bed rail in the condition shown in FIG. 10.
Figure 12:
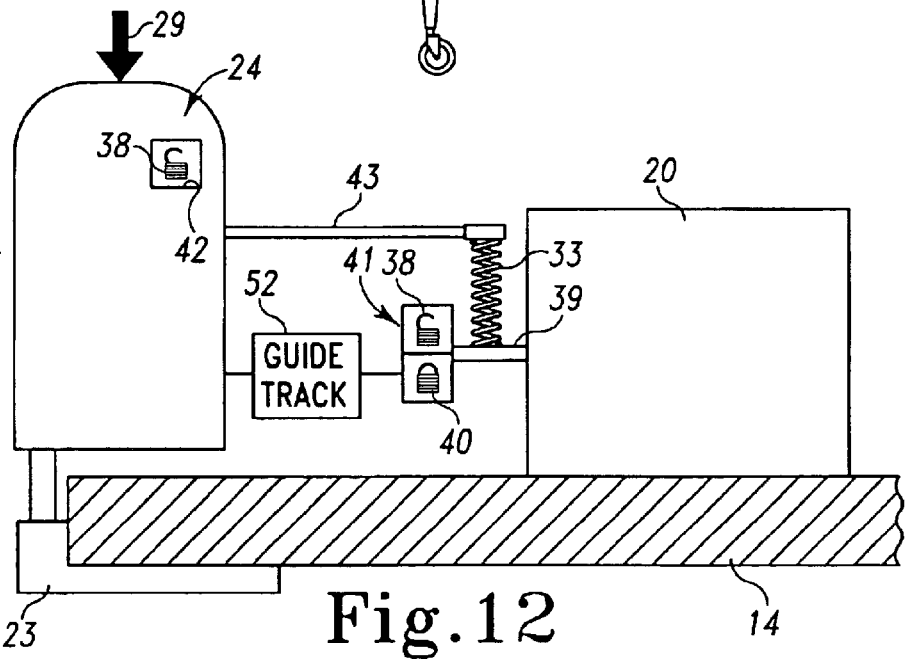
FIG. 12 is a diagrammatic view corresponding to the condition shown in FIGS. 10 and 11 in which the unclamped signal is still displayed and the spring is still in its generally relaxed state.
Figure 13:
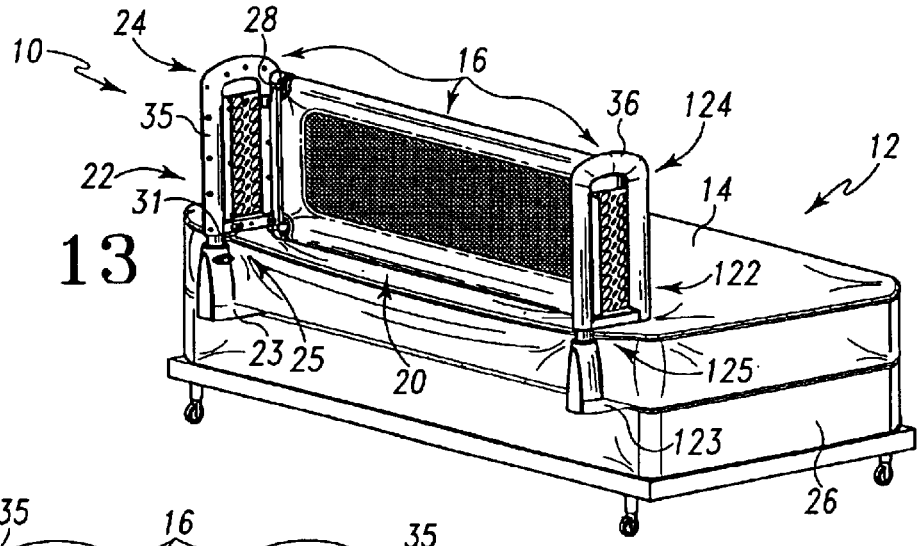
FIG. 13 is a perspective view showing clamping of the mattress with a clamping force in compliance with the predetermined clamping force criteria.
Figure 14:
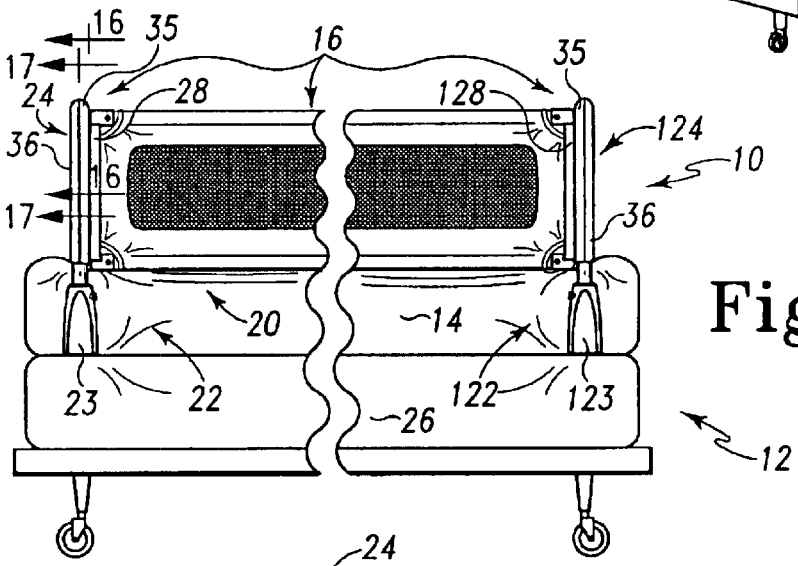
FIG. 14 is a rear elevation view of the bed rail in the condition shown in FIG. 13.

Left motion controller 25 is configured to control movement of left movable jaw 24 relative to left fixed jaw 23 and right motion controller 125 is configured to control movement of right movable jaw 124 relative to right fixed jaw 123, as suggested, for example, in FIGS. 2, 10, and 11. In the illustrated embodiment, each motion controller 25, 125 includes a ratchet 32 and a ratchet engagement device 31 configured to engage ratchet 32. Motion controllers 25, 125 are discussed further in U.S. patent application Ser. No. 10/735,356 entitled "Bed Rail", filed on Dec. 12, 2003.

Left and right clamps 22, 122 are similar to one another in structure and function. Thus, further description herein of left clamp 22 and its components applies also to right clamp 122 and its components.

Left and right clamping force indicators 18, 118 are similar to one another in structure and function. Thus, further description herein of left clamping force indicator 18 applies also to right clamping force indicator 118.

Figure 4:
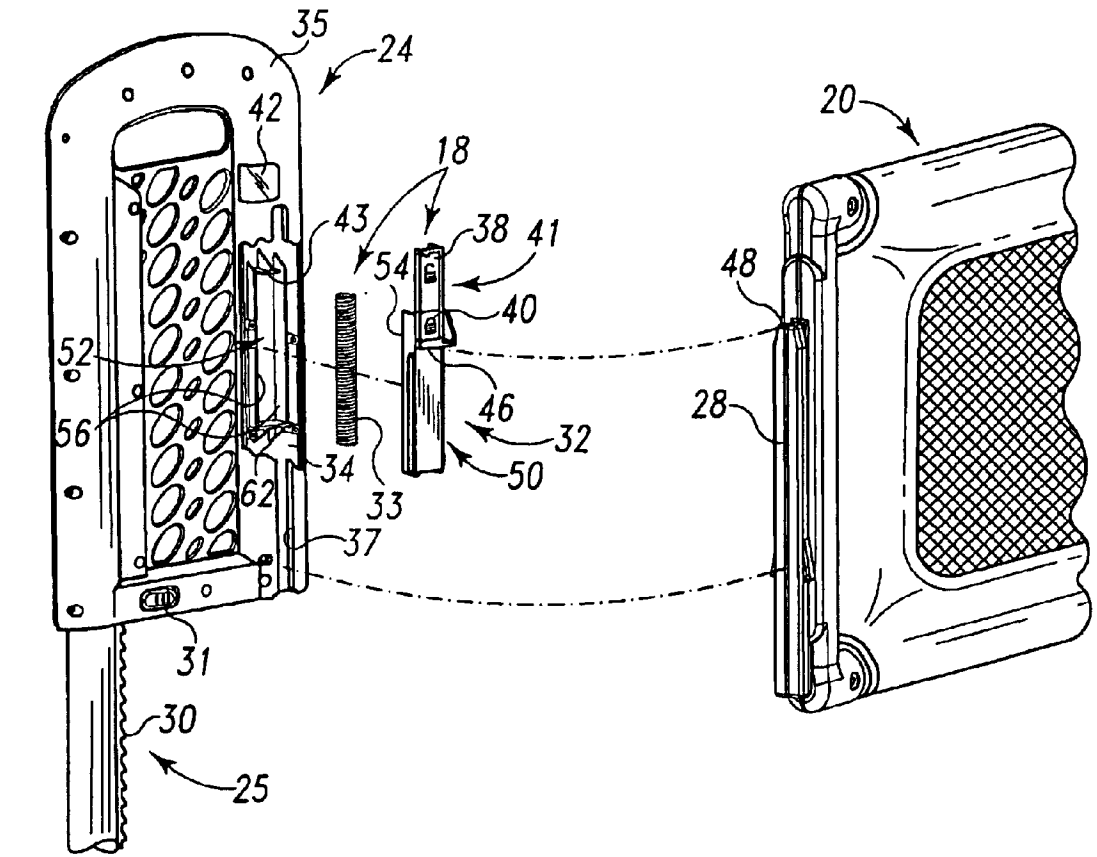
FIG. 4 is an exploded perspective view, with portions broken away, showing components of the left clamping force indicator including a spring and a body that includes a spring mount for the spring, a signaler including the clamped and unclamped signals, and a slide configured for engagement with a guide track formed in the left movable jaw.
Figure 3:
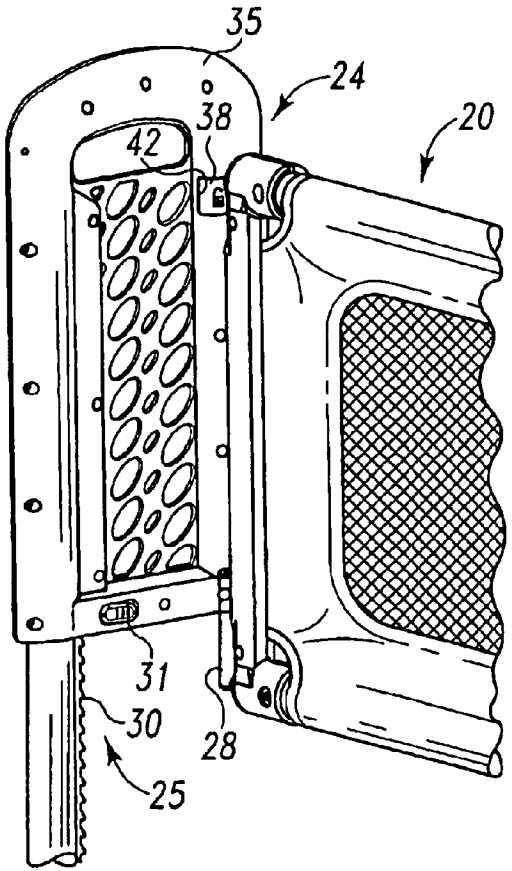
FIG. 3 is an enlarged perspective view, with portions broken away, showing a left end portion of the side rail coupled to a left movable jaw of the left clamp and showing an unclamped signal of the left clamping force indicator displayed in a window of the left movable jaw to indicate that the leftclamping force does not comply with the predetermined clamping force criteria.
Figure 5:
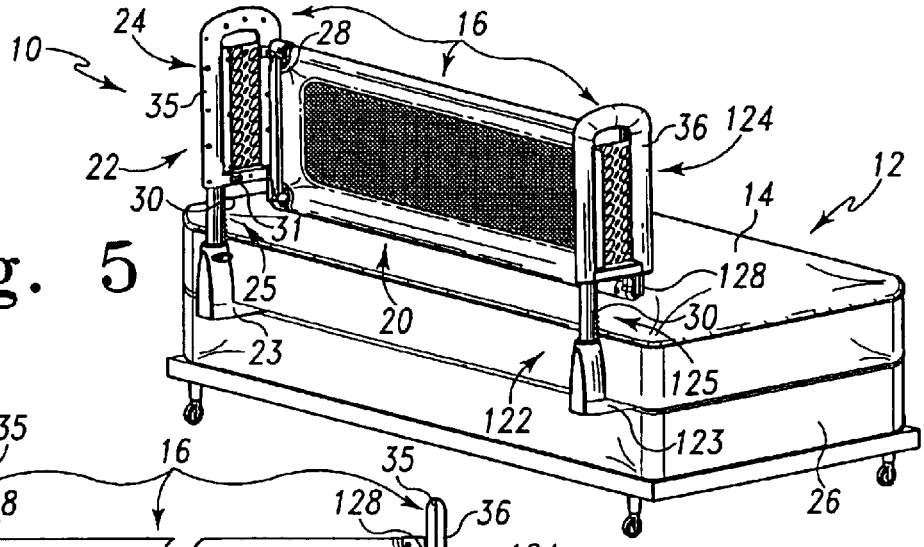
FIG. 5 is a perspective view showing the bed rail in an unclamped position.
Figure 6:
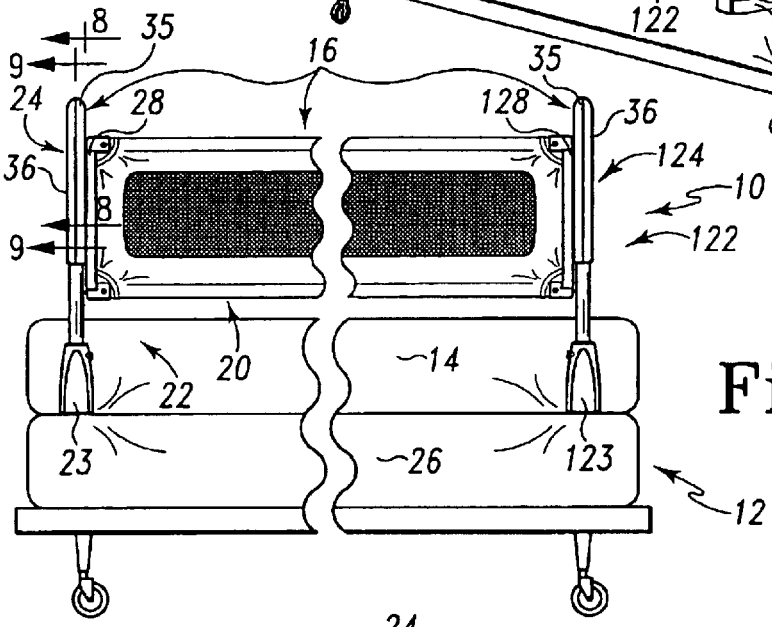
FIG. 6 is a rear elevation view of the bed rail in the condition shown in FIG. 5.
Figure 7:
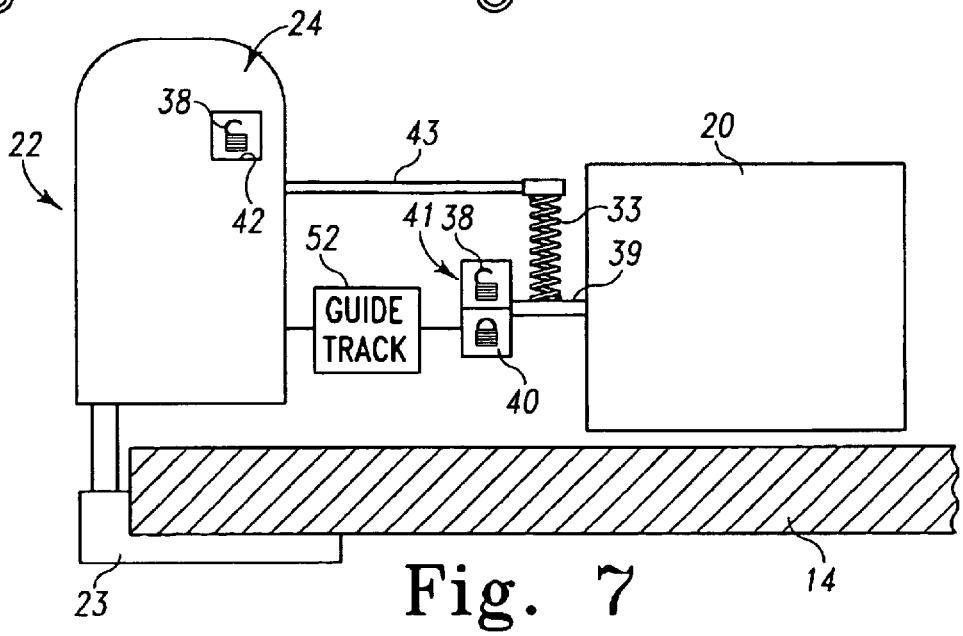
FIG. 7 is a diagrammatic view corresponding to the condition shown in FIGS. 5 and 6 in which the unclamped signal is displayed and the spring is generally relaxed.
Figure 8:
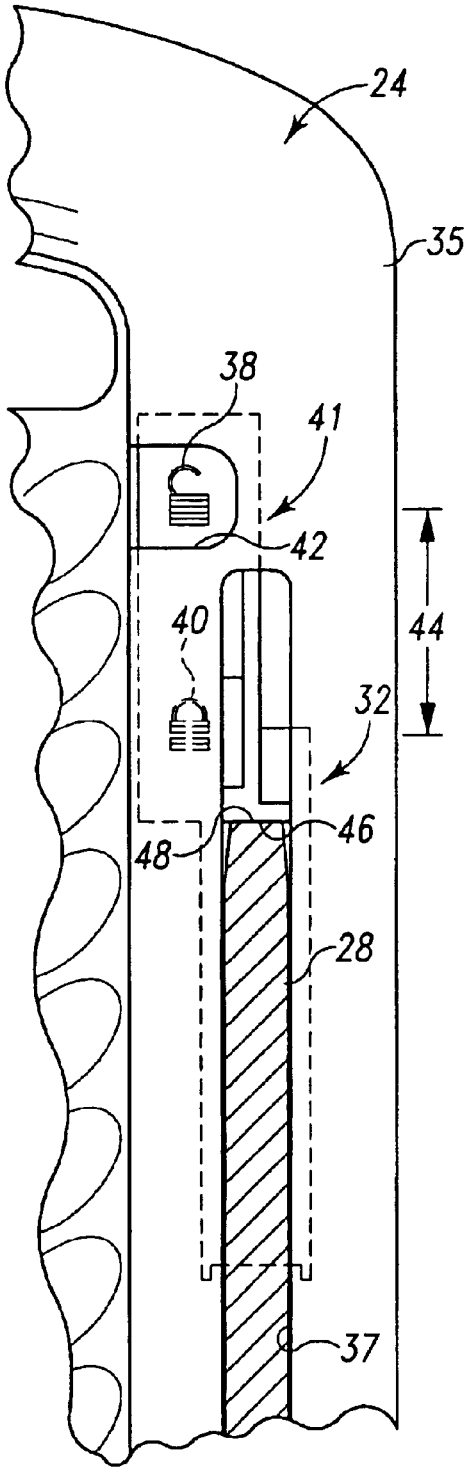
FIG. 8 is a sectional view taken along lines 8—8 of FIG. 6, with portions broken away, showing display of the unclamped signal of the left clamping force indicator in the window of the left movable jaw and engagement between a left end portion of the side rail and a load transmitter of the body of the left clamping force indicator.

In the illustrated embodiment, indicator 18 includes a body 32 and an elastic device 33, as shown, for example, in FIG. 4. Body 32 and elastic device 33 are positioned in an interior region 34 formed in movable jaw 24. Interior region 34 is provided by inner and outer shells 35, 36 included in movable jaw 24. Body 32 is positioned on end portion 28 which extends through a slot 37 formed in an inner shell 35. Elastic device 33 is positioned between a mount 39 included in body 32 and a tab 43 fixed to outer shell 36. Body 32 and elastic device 33 thus cooperate to interconnect side rail 20 and movable jaw 24.

Figure 15:
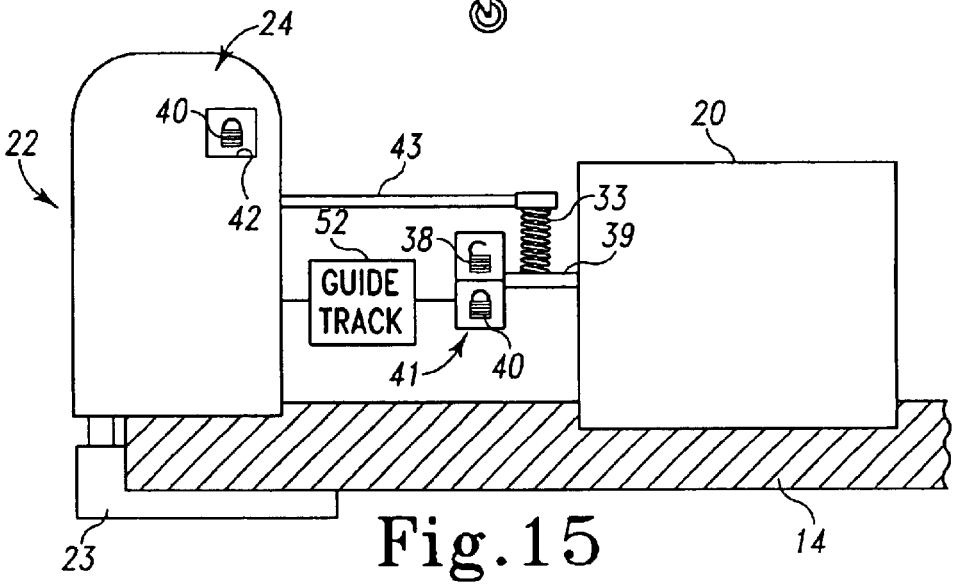
FIG. 15 is a diagrammatic view corresponding to the condition shown in FIGS. 13 and 14 in which the clamped signal is displayed and the spring is loaded.
Figure 16:
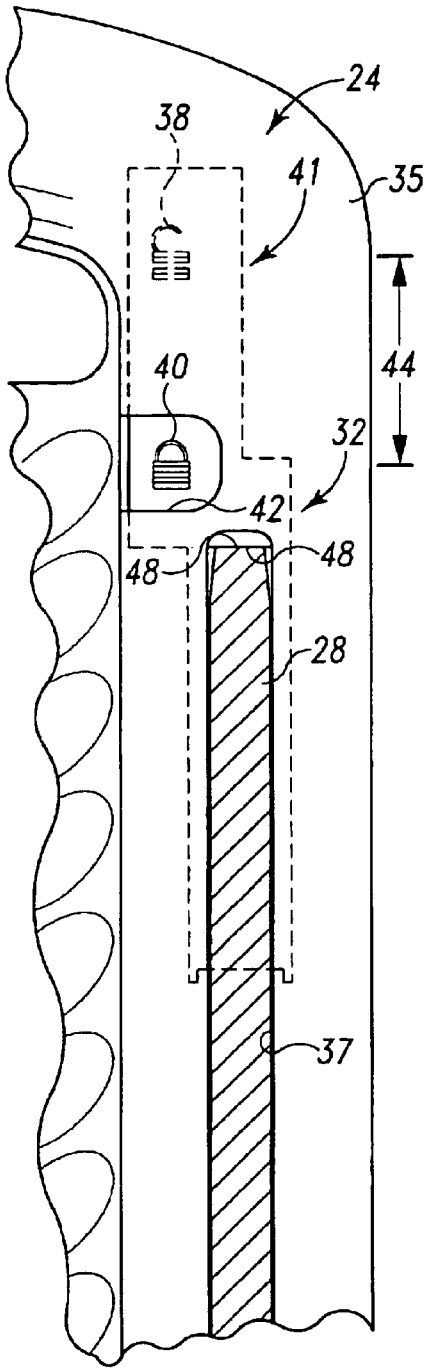
FIG. 16 is a sectional view taken along lines 16—16 of FIG. 14, with portions broken away, showing display of the clamped signal of the left clamping force indicator in the window of the left movable jaw.

Body 27 further includes a signaler 41 configured to display either an unclamped signal 38 or a clamped signal 40 in a window 42 included in inner shell 35. Signaler 41 displays unclamped signal 38 in window 42 when the left clamping force does not comply with the predetermined clamping force criteria, as shown, for example, in FIGS. 7–9 and 12 and displays the clamped signal 40 in window 42 when the left clamping force does comply with the predetermined clamping force criteria, as shown, for example, in FIGS. 15–17.

The predetermined clamping force criteria is, for example, a force of about 10 pounds (about 44.5 Newtons). Thus, in the illustrated embodiment, when the left clamping force is less than about 10 pounds (about 44.5 Newtons), signaler 41 displays unclamped signal 38 in window 42. When the left clamping force is at least about 10 pounds (about 44.5 Newtons), signaler 41 displays clamped signal 40 in window 42.

Signals 38, 40 are color-coded and include symbols suggestive of unclamping and clamping. Unclamped signal 38 includes a symbol of an unlocked lock on a red background. Clamped signal 40 includes a symbol of a locked lock on a green background. Signals 38, 40 cooperate to provide an adhesive sticker coupled to body 32.

It is within the scope of this disclosure for signaler 41 to be configured in other forms to provide information about clamping force. For example, signaler 41 may include an analog scale or digital readout to display the current value of the clamping force or some other value relatively close thereto. In addition to or in place of a visible display, signaler 41 may employ audio and/or tactile indications of the clamping force.

Movable jaw 24 and side rail 20 are configured for relative movement to facilitate display of signals 38, 40 by signaler 41 upon clamping and unclamping of mattress 14. Before mattress 14 is clamped, movable jaw 24 and side rail 20 are oriented in an unclamped position so that unclamped signal 38 appears in window 42, as shown, for example, in FIGS. 7–9 and 12. During clamping of mattress 14, movable jaw 24 and side rail 20 are moved relative to one another to a clamped position so that clamped signal 40 appears in window 42, as shown, for example, in FIGS. 15–17. Upon unclamping mattress 14, movable jaw 24 and side rail 20 are moved back to their unclamped position so that unclamped signal 38 reappears in window 42.

Movable jaw 24 and side rail 20 move from the unclamped position to the clamped position upon movement of movable jaw 24 toward fixed jaw 23 and engagement between side rail 20 and mattress 14. Movable jaw 24 and side rail 20 move together until engagement occurs between side rail 20 and mattress 14. Once such engagement occurs, side rail 20 is prevented from moving downward to the same extent as movable jaw 24 upon further downward movement of movable jaw 24. As elevation adjustment force 30 continues to move movable jaw 24 downward, side rail 20 is pressed more and more against mattress 14 so that the clamping force is applied to mattress 14 with increasing intensity. In addition, movable jaw 24 is caused to move downward along, and thus relative to, side rail 20.

Window 42 moves along signaler 41 a predetermined distance 44 from unclamped signal 38 to clamped signal 40 upon movement of movable jaw 24 along side rail 20 from the unclamped position to the clamped position, as shown, for example, in FIGS. 8, 9, 16, and 17. Window 42 moves along signaler 41 in the opposite direction so that unclamped signal 38 reappears in window 42 upon relative movement between movable jaw 24 and side rail 20 from the clamped position to the unclamped position. Predetermined distance 44 is, for example, about 1.7 inches (about 43 millimeters).

Elastic device 33 is shown, for example, in FIGS. 4, 7, 9, 12, 15, and 17. Elastic device 33 is configured to resist relative motion between movable jaw 24 and side rail 20 upon clamping mattress 14 and is configured to cause relative motion between movable jaw 24 and side rail 20 upon unclamping mattress 14. In this way, elastic device 33 promotes display of clamped signal 40 in window 42 when the clamping force complies with the predetermined clamping force criteria and display of unclamped signal 38 in window 42 when the clamping force does not comply with the predetermined clamping force criteria.

Elastic device 33 is configured, for example, as a spring. Spring 33 is positioned on, and thus coupled to, mount 39, which may be referred to as a spring mount. Tab 43 engages spring 33 to compress or otherwise load spring 33 upon clamping of mattress 14. Tab 43 may thus be referred to as a loader or spring loader. When loaded, spring 33 acts against tab 43 to resist relative movement between movable jaw 24 and side rail 20 upon clamping of mattress 14 and to cause relative movement between movable jaw 24 and side rail 20 upon unclamping of mattress 14. The spring constant of spring 33 and predetermined distance 44 cooperate to establish the predetermined clamping force criteria.

Loading of spring 33 is transmitted through body 32 to end portion 28 for application of the clamping force to mattress 14. As such, body 32 includes a load transmitter 46 shown, for example, in FIGS. 4, 8, and 16. Load transmitter 46 is positioned between spring mount 39 and signaler 41 and is configured, for example, as a downwardly facing surface urged into engagement with an upwardly facing surface 48 of end portion 28 by spring 33.

Figure 9:
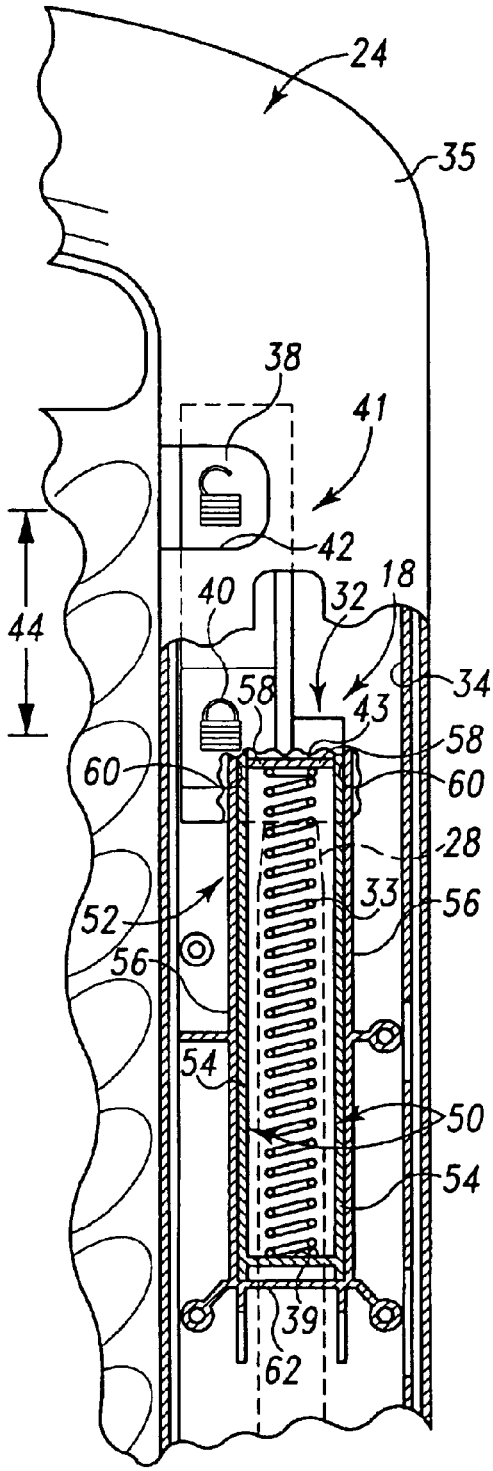
FIG. 9 is a sectional view taken along lines 9—9 of FIG. 6, with portions broken away, showing the spring in a generally relaxed state when the unclamped signal is displayed.
Figure 17:
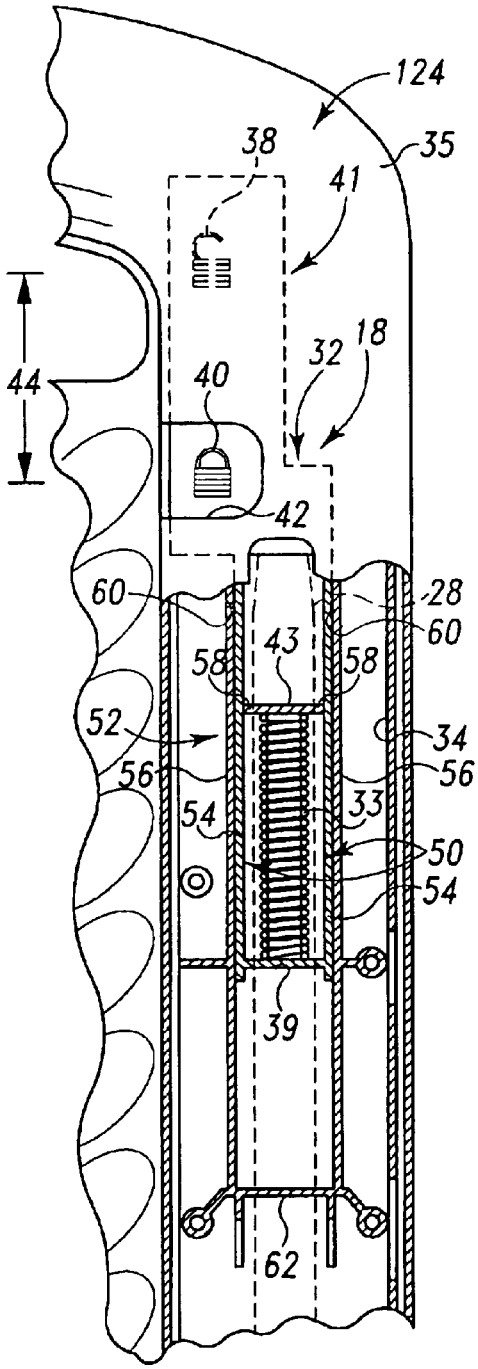
FIG. 17 is a sectional view taken along lines of FIG. 14, with portions broken away, showing compression of the spring of the left clamping force indicator upon display of the clamped signal.

Body 32 includes a slide 50 and movable jaw 24 includes a guide track 52 fixed to outer shell 36, as shown, for example, in FIGS. 4, 9, and 17. Slide 50 and guide track 52 are configured for relative slidable movement against one another to facilitate relative movement between movable jaw 24 and side rail 20. Slide 50 includes a pair of parallel slide walls 54 to which spring mount 39 is coupled and between which spring 33 is positioned. Guide track 52 includes a pair of parallel track walls 56 and a pair of outer edges 58 that are included in tab 43 and spaced apart from track walls 56 to provide a pair of gaps 60. Gaps 60 are configured to receive slide walls 54 to facilitate compression of spring 33 against spring mount 39 by tab 43 upon clamping of mattress 14, as shown, for example, in FIG. 17.

A stop 62 is coupled to track walls 56, as shown, for example, in FIGS. 4, 9, and 17. Stop 62 is configured to engage body 32 to stop relative movement between movable jaw 24 and side rail 20 so that unclamped signal 38 will appear in window 42 upon unclamping of mattress 14.

Left clamping force indicator 18 provides means for indicating whether the left clamping force complies with predetermined clamping force criteria upon relative movement between movable jaw 24 and side rail 20 due to movement of movable jaw 24 toward fixed jaw 23 and engagement between side rail 20 and mattress 14. Right clamping force indicator 118 provides means for indicating whether the right clamping force complies with predetermined clamping force criteria upon relative movement between movable jaw 124 and side rail 20 due to movement of movable jaw 124 toward fixed jaw 123 and engagement between side rail 20 and mattress 14.

Figure 18:
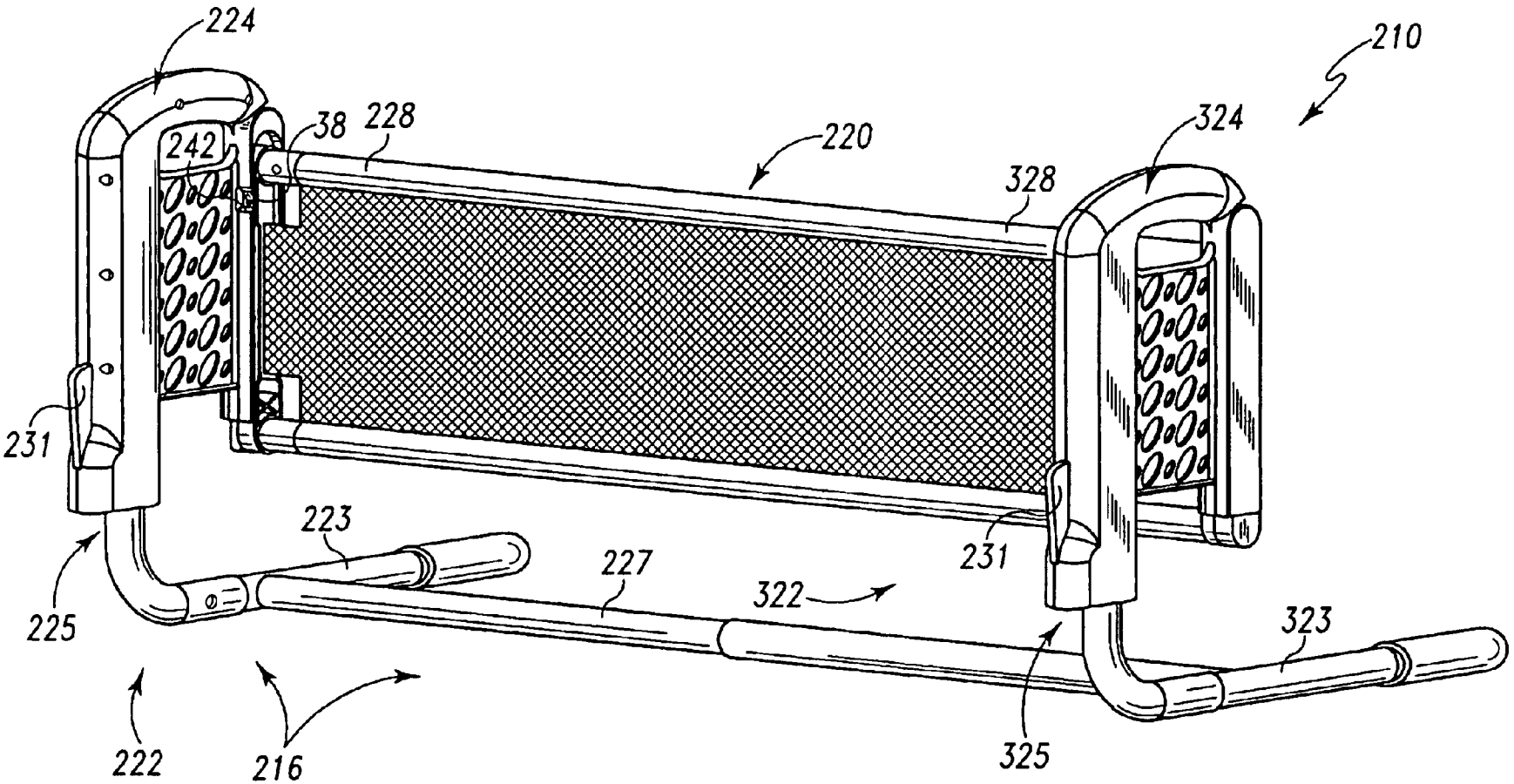
FIG. 18 is a perspective view of another bed rail which includes left and right clamps coupled to a side rail extending therebetween.

A bed rail 210 shown, for example, in FIG. 18 is configured for use with bed 12. Bed rail 210 includes a mattress clamping device 216 configured to clamp mattress 14 with a clamping force to mount bed rail 210 alongside mattress 14. A clamping force indicator included in bed rail 210 is configured to provide information about the clamping force. In the embodiment illustrated in FIGS. 18 and 19, bed rail 210 includes two such clamping force indicators, a left clamping force indicator 218 and a right clamping force indicator (not shown). Each indicator is configured to indicate whether a clamping force applied to mattress 14 complies with predetermined clamping force criteria.

Mattress clamping device 216 includes a side rail 220, a left clamp 222, and a right clamp 322, as shown, for example, in FIG. 18. Each clamp 222, 322 is configured to cooperate with side rail 220 to clamp mattress 14 with a clamping force to mount side rail 20 alongside mattress 14. Left clamp 222 cooperates with side rail 220 to clamp mattress 14 with a left clamping force and right clamp 322 cooperates with side rail 20 to clamp mattress 14 with a right clamping force. Left clamping force indicator 218 is used to indicate whether the left clamping force complies with the predetermine clamping force criteria. The right clamping force indicator is used to indicate whether the right clamping force complies with the predetermined clamping force criteria.

Left clamp 222 includes a left fixed jaw 223, a left movable jaw 224, and a left motion controller 225 and right clamp 214 includes a right fixed jaw 323, a right movable jaw 323, and a right motion controller 325. Fixed jaws 223, 323 are configured to be positioned under mattress 14 in a fixed position between mattress 14 and underlying box spring unit 26. A jaw connector 227 is coupled to left and right fixed jaws 223, 323.

Movable jaws 224, 324 are configured to move relative to fixed jaws 223, 323 and to act through left clamping force indicator 218 and the right clamping force indicator to move side rail 220 relative to mattress 14 to clamp and unclamp mattress 14. Left movable jaw 224 is configured to move toward left fixed jaw 223 to move a left end portion 228 of side rail 20 toward mattress 14 to clamp mattress 14 with the left clamping force between left end portion 228 and left fixed jaw 223 upon application of an elevation adjustment force to left movable jaw 224. Left movable jaw 224 is configured to move away from left fixed jaw 223 to move left end portion 228 away from mattress 14 to unclamp mattress 14. Right movable jaw 324 is configured to move toward right fixed jaw 323 to move a right end portion 328 of side rail 220 toward mattress 14 to clamp mattress 14 with the right clamping force between right end portion 328 and right fixed jaw 323 upon application of the elevation adjustment force to right movable jaw 324. Right movable jaw 324 is configured to move away from right fixed jaw 323 to move right end portion 328 away from mattress 14 to unclamp mattress 14.

Left motion controller 225 is configured to control movement of left movable jaw 224 relative to left fixed jaw 223 and right motion controller 325 is configured to control movement of right movable jaw 324 relative to right fixed jaw 323. Each motion controller 225, 325 includes a ratchet (not shown) coupled to a leg 230 and a pivotable ratchet engagement device 231 configured to engage and disengage the ratchet. Motion controllers 225, 325 are discussed further in U.S. patent application No. 10/735,356 entitled "Bed Rail", filed on Dec. 12, 2003.

Left and right clamps 222, 322 are similar to one another in structure and function. Thus, further description herein of left clamp 222 and its components applies also to right clamp 322 and its components.

Left clamping force indicator 218 and the right clamping force indicator are similar to one another in structure and function. Thus, further description herein of left clamping force indicator 218 applies also to the right clamping force indicator.

Figure 19:
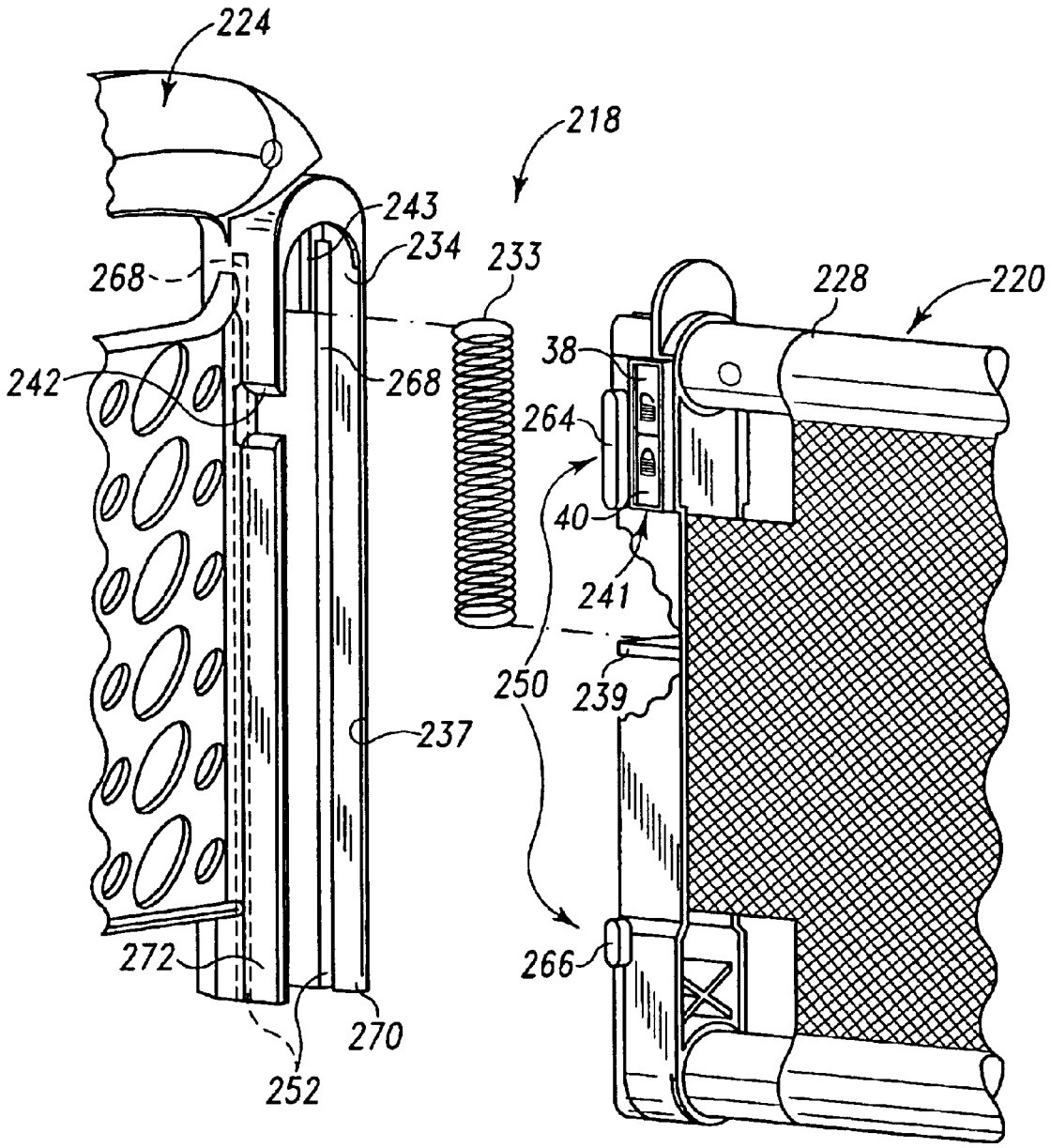
FIG. 19 is an enlarged perspective view, with portions broken away, showing components of a left clamping force indicator used in the bed rail of FIG. 18.

Left clamping force indicator 218 includes a signaler 241 configured to display either unclamped signal 38 or clamped signal 40 in a window 242 formed in movable jaw 224, as shown, for example, in FIGS. 18 and 19. Signaler 241 displays unclamped signal 38 in window 242 when the left clamping force does not comply with the predetermined clamping force criteria, as shown, for example, in FIG. 18, and displays clamped signal 40 in window 242 when the left clamping force does comply with the predetermined clamping force criteria.

Signaler 241 is coupled to side rail 220, as shown, for example, in FIG. 19. Signals 38, 40 cooperate to provide an adhesive sticker coupled to a signal mount 245 included in signaler 241 and coupled to end portion 228 of side rail 220. End portion 228 extends through a slot 237 into an interior region 234 formed in movable jaw 224 for display of signals 38, 40 in window 242.

The predetermined clamping force criteria for clamping force indicator 218 is, for example, a force of about 20 pounds (about 89 Newtons). Thus, when the left clamping force is less than about 20 pounds (about 89 Newtons), signaler 241 displays unclamped signal 38 in window 242. When the left clamping force is at least about 20 pounds (about 89 Newtons), signaler 241 displays clamped signal 40 in window 242.

Left clamping force indicator 218 includes an elastic device 233, a mount 239, and loader 243, as shown, for example, in FIG. 19. Elastic device 233 is configured, for example, as a spring positioned between mount (or spring mount) 239 and loader (or spring loader) 243. Device 233 is positioned on mount 239 and is configured to be compressed by loader 243 upon clamping mattress 14. Mount 239 is configured, for example, as a wall coupled to end portion 228 of side rail 220 and positioned in a recess (not shown) formed in end portion 228. Loader 243 is configured, for example, as a tab coupled to movable jaw 224 and positioned in interior region 234 formed in movable jaw 224.

Movable jaw 224 and side rail 220 are configured for movement relative to one another to facilitate display of signals 38, 40 by signaler 241 upon clamping and unclamping mattress 14. When mattress 14 is unclamped, movable jaw 224 and side rail 220 are oriented in an unclamped position so that unclamped signal 38 appears in window 242, as shown, for example, in FIG. 18. A stop (not shown) is coupled to end portion 228 and engages movable jaw 224 to prevent detachment of side rail 220 from movable jaw 224 when movable jaw 224 and side rail 220 are in the unclamped position. During clamping of mattress 14, movable jaw 224 and side rail 220 slide relative to one another to a clamped position so that clamped signal 40 appears in window 242. Upon unclamping mattress 14, movable jaw 224 and side rail 220 are moved back to their unclamped position so that unclamped signal 38 reappears in window 242.

A user of bed rail 210 presses down on movable jaw 224 with the elevation adjustment force to cause clamping of mattress 14. Application of the elevation adjustment force to movable jaw 224 causes movable jaw 224 to move downward toward fixed jaw 223 and causes side rail 220 to move toward mattress 14. Movable jaw 224 and side rail 220 do not move relative to one another, at least for the most part, until side rail 220 engages mattress 14.

Relative movement between movable jaw 224 and side rail 220 begins to occur once side rail 220 engages mattress 14. Continued application of the elevation adjustment force to movable jaw 224 causes movable jaw 224 to continue to move downward toward fixed jaw 223. Engagement between side rail 220 and mattress 14 prevents side rail 220 from moving downward to the same extent as movable jaw 224.

Relative movement between movable jaw 224 and side rail 220 causes loading of elastic device 233 upon clamping of mattress 14. Device 233 is loaded due to compression of device 233 against mount 239 by loader 243. Loading of device 233 is transmitted to side rail 220 to increase the clamping force applied to mattress 14. As device 233 is loaded, it resists relative movement between movable jaw 224 and side rail 220 so that signaler 241 will display unclamped signal 38 in window 242 when the clamping force does not comply with the predetermined clamping force criteria and will display clamped signal 40 in window 242 when the clamping force does comply with the predetermined clamping force criteria. When mattress 14 is unclamped, device 233 causes relative movement between movable jaw 224 and side rail 220 so that unclamped signal 38 reappears in window 242.

Clamping force indicator 218 and movable jaw 224 are configured for relative slidable movement upon clamping and unclamping of mattress 14. Clamping force indicator 218 includes a slide 250, as shown, for example, in FIG. 19. Movable jaw 224 includes a guide track 252 for slidable engagement with slide 250.

Slide 250 includes a pair of larger lugs 264 and a pair of smaller lugs 266, as shown, for example, in FIG. 19 with respect to one larger lug 264 and one smaller lug 266. Larger lugs 264 are coupled to and positioned on opposite sides of end portion 228. Similarly, smaller lugs 266 are coupled to and positioned on opposite sides of end portion 228. Lugs 264, 266 on the same side of end portion 228 are spaced apart from one another.

Guide track 252 includes a pair of grooves 268 formed in interior region 234 of movable jaw 224, as shown, for example, in FIG. 19 with respect to one of grooves 268. A first wall 270 is formed to include one of grooves 268. A second wall 272 is formed to include the other groove 268 as well as window 242. Each groove 268 receives one of larger lugs 264 and one of smaller lugs 266 for relative slidable movement between movable jaw 224 and side rail 220.

Left clamping force indicator 218 provides means for indicating whether the left clamping force complies with predetermined clamping force criteria upon relative movement between movable jaw 224 and side rail 220 due to movement of movable jaw 224 toward fixed jaw 223 and engagement between side rail 220 and mattress 14. The right clamping force indicator provides means for indicating whether the right clamping force complies with predetermined clamping force criteria upon relative movement between movable jaw 324 and side rail 220 due to movement of movable jaw 324 toward fixed jaw 323 and engagement between side rail 220 and mattress 14.

What is claimed is:

1. A bed rail comprising a side rail, a clamp including a fixed jaw adapted to be positioned under a mattress in a fixed position and a movable jaw configured to move toward the fixed jaw to move the side rail toward the mattress to clamp the mattress between the side rail and the fixed jaw with a clamping force to mount the side rail alongside the mattress, and means for indicating whether the clamping force complies with predetermined clamping force criteria upon relative movement between the movable jaw and the side rail due to movement of the movable jaw toward the fixed jaw and engagement between the side rail and the mattress.

2. The bed rail of claim 1, wherein the indicating means includes a signaler including a clamped signal and an unclamped signal, the signaler is configured to display the clamped signal when the clamping force complies with the predetermined clamping force criteria, and the signaler is configured to display the unclamped signal when the clamping force does not comply with the predetermined clamping force criteria.

3. The bed rail of claim 1, wherein the indicating means includes a clamped signal, an unclamped signal, and a spring configured to resist relative movement between the movable jaw and the side rail upon movement of the movable jaw toward the fixed jaw and engagement between the side rail and the mattress to promote display of the clamped signal when the clamping force complies with the predetermined clamping force criteria and to promote display of the unclamped signal when the clamping force does not comply with the predetermined clamping force criteria.

4. The bed rail of claim 1, wherein the indicating means includes a slide, the movable jaw includes a guide track, and the slide and the guide track are configured for relative slidable movement against one another upon relative movement between the movable jaw and the side rail.

5. The bed rail of claim 1, wherein the indicating means includes a spring and a body coupled to the side rail, the body includes a spring mount to which the spring is coupled, a slide, and a signaler, the movable jaw includes a guide track and a window, the slide and the guide track are configured for relative slidable movement against one another to facilitate relative movement between the movable jaw and the side rail, and the spring is configured to resist movement of the movable jaw relative to the side rail upon movement of the movable jaw toward the fixed jaw and engagement between the side rail and the mattress so that the signaler will display a clamped signal in the window when the clamping force complies with the predetermined clamping force criteria and will display an unclamped signal in the window when the clamping force does not comply with the predetermined clamping force criteria.

6. The bed rail of claim 1, wherein the indicating means includes a spring mount coupled to the side rail, a spring loader coupled to the movable jaw, and a spring positioned between the spring mount and the spring loader to be compressed against the spring mount by the spring loader upon relative movement between the movable jaw and the side rail.

7. The bed rail of claim 1, wherein the indicating means includes a lug coupled to the side rail and the movable jaw is formed to include a groove to receive the lug therein for relative slidable movement between the lug and the groove upon relative movement between the movable jaw and the side rail.

8. A bed rail comprising a side rail, a clamp configured to cooperate with the side rail to clamp a mattress with a clamping force to mount the side rail alongside the mattress, and a clamping force indicator configured to provide information about the clamping force.

9. The bed rail of claim 8, wherein the clamping force indicator is configured to indicate whether the clamping force complies with predetermined clamping force criteria.

10. The bed rail of claim 9, wherein the clamping force indicator includes a signaler configured to display a clamped signal when the clamping force complies with the predetermined clamping force criteria and to display an unclamped signal when the clamping force does not comply with the predetermined clamping force criteria.

11. The bed rail of claim 9, wherein the clamp and the side rail are configured for movement relative to one another upon clamping and unclamping the mattress and the clamping force indicator includes an elastic device configured to resist relative movement between the clamp and the side rail upon clamping the mattress and configured to cause relative movement between the clamp and the side rail upon unclamping the mattress.

12. The bed rail of claim 8, wherein the clamp includes a fixed jaw and a movable jaw, the fixed jaw is adapted to be positioned under the mattress in a fixed position, and the movable jaw is configured to move relative to the fixed jaw and to act through the clamping force indicator to move the side rail toward the mattress to clamp the mattress between the side rail and the fixed jaw with the clamping force.

13. The bed rail of claim 12, wherein the movable jaw and the side rail are configured for movement relative to one another and the clamping force indicator includes a spring configured to resist relative movement between the movable jaw and the side rail upon movement of the movable jaw toward the fixed jaw and engagement between the side rail and the mattress.

14. The bed rail of claim 12, wherein the movable jaw is formed to include a slot and the side rail includes an end portion extending through the slot for relative movement between the end portion and the slot.

15. The bed rail of claim 12, wherein the clamping force indicator includes a spring and a body, the body includes a spring mount to which the spring is coupled, a slide, a signaler, and a load transmitter, the movable jaw includes a guide track, a window, and a spring loader, the slide and the guide track are configured for relative slidable movement against one another to facilitate loading of the spring by the spring loader and to facilitate movement of the window relative to the signaler upon movement of the movable jaw toward the fixed jaw and engagement between the side rail and the mattress for display of the clamped signal in the window when the clamping force complies with the predetermined clamping force criteria and for display of the unclamped signal when the clamping force does not comply with predetermined clamping force criteria, and the load transmitter is configured to transmit loading of the spring to the side rail for application of the clamping force to the mattress.

16. The bed rail of claim 12, wherein the clamping force indicator includes a slide, the movable jaw includes a guide track, and the slide and the guide track are configured to slide against one another.

17. The bed rail of claim 16, wherein the slide includes a pair of lugs spaced apart from one another and coupled to an end portion included in the side rail and the movable jaw is formed to include a groove to receive the pair of lugs therein.

18. The bed rail of claim 8, further comprising a second clamp and a second clamping force indicator, wherein the second clamp is configured to cooperate with the side rail to clamp the mattress with a second clamping force to mount the side rail alongside the mattress, and the second clamping force indicator is configured to provide information about the second clamping force.

19. The bed rail of claim 18, wherein the clamp and the clamping force indicator are positioned adjacent to a first end portion of the side rail and the second clamp and the second clamping force indicator are positioned adjacent to a second end portion of the side rail.

20. A bed rail comprising a side rail, a clamp including a fixed jaw adapted to be positioned under a mattress in a fixed position and a movable jaw configured to move relative to the fixed jaw to clamp the mattress between the side rail and the fixed jaw with a clamping force to mount the side rail alongside the mattress, the movable jaw including a window, and a clamping force indicator configured to indicate whether the clamping force complies with predetermined clamping force criteria, the clamping force indicator including a signaler and an elastic device, the movable jaw and the side rail being configured to move relative to one another to cause relative movement between the window and the signaler upon clamping and unclamping the mattress, the elastic device being configured to resist relative movement between the movable jaw and the side rail upon clamping the mattress and to cause relative movement between the movable jaw and the side rail upon unclamping the mattress so that the signaler will display a clamped signal in the window when the clamping force complies with the predetermined clamping force criteria and will display an unclamped signal in the window when the clamping force does not comply with the predetermined clamping force criteria.

21. The bed rail of claim 20, wherein the elastic device is a spring.

22. The bed rail of claim 21, wherein the clamping force indicator includes a body that is coupled to the side rail and includes the signaler, a spring mount to which the spring is coupled, and a slide, the movable jaw includes a guide track and a spring loader, and the slide and the guide track are configured for relative slidable movement against one another to facilitate loading of the spring by the spring loader and movement of the window along the signaler upon movement of the movable jaw toward the fixed jaw and engagement between the side rail and the mattress.

23. The bed rail of claim 22, wherein the slide includes a pair of parallel slide walls to which the spring mount is coupled, the spring is positioned between the slide walls and positioned on the spring mount, the spring loader is a tab, the guide track includes a pair of outer edges included in the tab and a pair of parallel track walls spaced apart from the outer edges to provide a pair of gaps, and the gaps are configured to receive the slide walls to facilitate compression of the spring against the spring mount by the tab upon movement of the movable jaw toward the fixed jaw and engagement between the side rail and the mattress.

24. The bed rail of claim 20, wherein the clamping force indicator includes a slide, the movable jaw includes a guide track, and the slide and the guide track are configured for relative slidable movement against one another upon relative movement between the movable jaw and the side rail.

25. The bed rail of claim 20, wherein clamping force indicator includes a pair of lugs spaced apart from one another and coupled to an end portion included in the side rail and the movable jaw is formed to include a groove to receive the pair of lugs therein.

26. A bed rail comprising a mattress clamping device that includes a side rail and is adapted to clamp a mattress with a clamping force to mount the side rail alongside the mattress and a clamping force indicator configured to provide information about the clamping force.

27. The bed rail of claim 26, wherein the clamping force indicator is configured to indicate whether the clamping force complies with predetermined clamping force criteria.

28. The bed rail of claim 26, wherein the mattress clamping device includes and a clamp, the clamp includes a fixed jaw adapted to be positioned under the mattress in a fixed position and a movable jaw configured to move toward the fixed jaw to move the side rail toward the mattress to clamp the mattress between the side rail and the fixed jaw to mount the side rail alongside the mattress, and the clamping force indicator includes a body and a spring, the body is coupled to the side rail and includes a spring mount and a signaler, the spring is coupled to the spring mount and is configured to resist movement of the movable jaw relative to the side rail upon movement of the movable jaw toward the fixed jaw and engagement between the side rail and the mattress so that the signaler will display a clamped signal in a window formed in the movable jaw when the clamping force complies with predetermined clamping force criteria and will display an unclamped signal in the window when the clamping force does not comply with the predetermined clamping force criteria.

* * * * *